US009102035B2

(12) United States Patent
Bovo et al.

(10) Patent No.: US 9,102,035 B2
(45) Date of Patent: Aug. 11, 2015

(54) METHOD FOR MACHINING SEED RODS FOR USE IN A CHEMICAL VAPOR DEPOSITION POLYSILICON REACTOR

(75) Inventors: Rodolfo Bovo, Merano (IT); Paolo Molino, Merano (IT)

(73) Assignee: MEMC Electronics Materials S.p.A., Novara (IT)

( * ) Notice: Subject to any disclaimer, the term of this patent is extended or adjusted under 35 U.S.C. 154(b) by 691 days.

(21) Appl. No.: 13/417,792

(22) Filed: Mar. 12, 2012

(65) Prior Publication Data

US 2013/0237126 A1 Sep. 12, 2013

(51) Int. Cl.

| | |
|---|---|
| ***B24B 49/12*** | (2006.01) |
| ***B24B 41/06*** | (2012.01) |
| ***B24B 1/00*** | (2006.01) |
| ***B24B 19/00*** | (2006.01) |
| ***B24B 7/16*** | (2006.01) |

(52) U.S. Cl.
CPC . *B24B 49/12* (2013.01); *B24B 7/16* (2013.01); *B24B 19/009* (2013.01)

(58) Field of Classification Search
CPC ..... B24B 49/12; B24B 19/009; B24B 7/16
USPC ..... 451/41, 5, 6
See application file for complete search history.

(56) References Cited

U.S. PATENT DOCUMENTS

| | | | | |
|---|---|---|---|---|
| 3,271,118 | A * | 9/1966 | Bhola | 117/49 |
| 3,647,530 | A * | 3/1972 | Dyer | 117/10 |
| 3,901,423 | A * | 8/1975 | Hillberry et al. | 225/2 |
| 5,674,106 | A * | 10/1997 | Cheetham | 451/8 |
| 5,911,822 | A * | 6/1999 | Abe et al. | 117/13 |
| 5,932,002 | A * | 8/1999 | Izumi | 117/13 |
| 6,059,876 | A | 5/2000 | Yin et al. | |
| 6,197,108 | B1 * | 3/2001 | Iino et al. | 117/13 |
| 6,312,517 | B1 | 11/2001 | Banan et al. | |
| 6,444,028 | B2 * | 9/2002 | Frauenknecht et al. | 117/218 |
| 6,676,916 | B2 * | 1/2004 | Keck et al. | 423/348 |
| 7,060,355 | B2 * | 6/2006 | Nakano et al. | 428/397 |
| 7,132,091 | B2 | 11/2006 | Kulkarni et al. | |
| 7,179,330 | B2 * | 2/2007 | Fusegawa et al. | 117/13 |
| 7,455,731 | B2 * | 11/2008 | Nakano et al. | 117/208 |
| 2003/0061985 | A1 | 4/2003 | Kulkarni et al. | |

(Continued)

FOREIGN PATENT DOCUMENTS

| | | |
|---|---|---|
| DE | 2538209 A1 | 3/1976 |
| DE | 3810738 C1 | 5/1989 |

(Continued)

OTHER PUBLICATIONS

DE 29918517 U1 Jan. 2000—English translation from Google Translate.*

(Continued)

*Primary Examiner* — Joseph J Hail
*Assistant Examiner* — Marc Carlson
(74) *Attorney, Agent, or Firm* — Armstrong Teasdale LLP

(57) ABSTRACT

A method for machining a profile into a silicon seed rod using a machine. The silicon seed rod is capable of being used in a chemical vapor deposition polysilicon reactor. The machine includes a plurality of grinding wheels. The method includes grinding a v-shaped profile into a first end of the silicon seed rod with one of the plurality of grinding wheels and grinding a conical profile in a second end of the silicon seed rod with another of the plurality of grinding wheels.

13 Claims, 8 Drawing Sheets

(56) References Cited

U.S. PATENT DOCUMENTS

| | | | | |
|---|---|---|---|---|
| 2003/0104202 | A1* | 6/2003 | Keck et al. | 428/364 |
| 2009/0145350 | A1 | 6/2009 | Narushima et al. | |
| 2010/0294999 | A1 | 11/2010 | Narushima et al. | |
| 2011/0203101 | A1* | 8/2011 | Gum et al. | 29/458 |
| 2012/0171845 | A1* | 7/2012 | Qin | 438/478 |
| 2012/0237678 | A1* | 9/2012 | Bovo et al. | 427/248.1 |
| 2013/0014738 | A1* | 1/2013 | Molino et al. | 125/14 |

FOREIGN PATENT DOCUMENTS

| | | | |
|---|---|---|---|
| DE | 29918517 | U1 | 1/2000 |
| DE | 29918517 | U1 * | 1/2000 |

OTHER PUBLICATIONS

Arnold Group NC 559-200—presented to public at SNEC in May 2012.*

Press Release of Arnold Group NC 559-200 at SNEC—Mar. 30, 2012.*

PCT International Search Report and Written Opinion of the International Searching Authority regarding PCT/EP2013/054881 filed on Mar. 11, 2013 mailed on Sep. 3, 2013. 8 pgs.

Kahler, Uwe, Darstellung, Charakterisierung und Oberflachenmodifizierung von Siliziumnanopartikeln in Si02, Abstract, Feb. 8, 2001, University of Halle, 2 pages.

Lide, D. R., CRC Handbook of Chemistry and Physics, 88th Edition, 2007-2008, 8 pages.

Lisak, A. et al., Vapor Pressure Measurements of Arsenic and Arsenic Trioxide Over Condensed Phases, Journal of Phase Equilibria, 1994, p. 151, vol. 15, No. 2.

Narayan, R., Advances in Bioceramics and Porous Ceramic IV, Ceramic Engineering and Science Proceedings, 2011 vol. 32, Issue No. 6, pp. 169-170.

* cited by examiner

METHOD FOR MACHINING SEED RODS FOR USE IN A CHEMICAL VAPOR DEPOSITION POLYSILICON REACTOR

FIELD

This disclosure generally relates to systems and methods for machining silicon and, more specifically, to systems for machining silicon seed rods for use in a chemical vapor deposition reactor.

BACKGROUND

Ultrapure polysilicon used in the electronic and solar industry is often produced through deposition from gaseous reactants via a chemical vapor deposition (CVD) process conducted within a reactor.

One process used to produce ultrapure polycrystalline silicon in a CVD reactor is referred to as a Siemens process. Silicon rods disposed within the reactor are used as seeds to start the process. Gaseous silicon-containing reactants flow through the reactor and deposit silicon onto the surface of the rods. The gaseous reactants (i.e., gaseous precursors) are silane-containing compounds such as halosilanes or monosilanes. The reactants are heated to temperatures above 1000° C. and under these conditions decompose on the surface of the rods. Silicon is thus deposited on the rods according to the following overall reaction:

$$2HSiCl_3 \rightarrow Si + 2HCl + SiCl_4.$$

The process is stopped after a layer of silicon having a predetermined thickness has been deposited on the surface of the rods. The silicon rods are then harvested from the reactor for further processing.

The silicon seed rods used in the reactor are formed from larger blocks or ingots of silicon that are cut by a saw to form the seed rods. The silicon seed rods typically have a circular or square cross-sectional shape. Pairs of silicon seed rods are connected in the reactor at their respective first ends by a silicon bridge rod. The opposing, second ends of the silicon seed rods are connected to a graphite chuck within the reactor.

In some systems, the first ends of the seed rods have a V-shaped or dovetail-like profile. The second ends of the rods have a conical profile to aid in connecting the ends to the graphite chuck. In these systems, an operator uses two separate machines and corresponding machining operations to machine the first and second ends of the seed rods. These machines machine the rods with a rotating grinding wheel and/or rotate the rods.

These systems suffer from a number of shortcomings, one of which is that they require two separate machines to machine one silicon seed rod. That is, one machine is required to machine the first end of the rod and a second machine is required to machine the second end. Moreover, the known systems are ill-equipped to machine rods that are not squares. For example, when the rods are cut from larger ingots into rods they may not have a true square cross-sectional shape. When such rods are mounted in a mandrel of the machines and rotated, the rotational axis of the mandrel may not coincide and instead be misaligned with the effective rotational axis of the rod. Such misalignment may result in poor-quality machining of the rod.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect is directed to a method for machining a profile into a silicon seed rod using a machine. The silicon seed rod is capable of being used in a chemical vapor deposition polysilicon reactor. The machine comprises a plurality of grinding wheels. The method comprises grinding a v-shaped profile into a first end of the silicon seed rod with one of the plurality of grinding wheels and grinding a conical profile in a second end of the silicon seed rod with another of the plurality of grinding wheels.

Another aspect is directed to a system for machining a profile into a silicon seed rod used in a chemical vapor deposition polysilicon reactor. The system comprises a frame for holding a plurality of silicon seed rods, a first grinding wheel for grinding a v-shaped profile into a first end of the silicon seed rods, and a second grinding wheel for grinding a conical profile into a second end of the silicon seed rods. An optical measurement system is configured for measuring at least one of the first end and the second end of the silicon seed rods. The grinding wheels are controlled based at least in part on an output of the optical measurement system.

BRIEF DESCRIPTION OF THE DRAWINGS

Like reference symbols in the various drawings indicate like elements.

DETAILED DESCRIPTION

Figure 1:
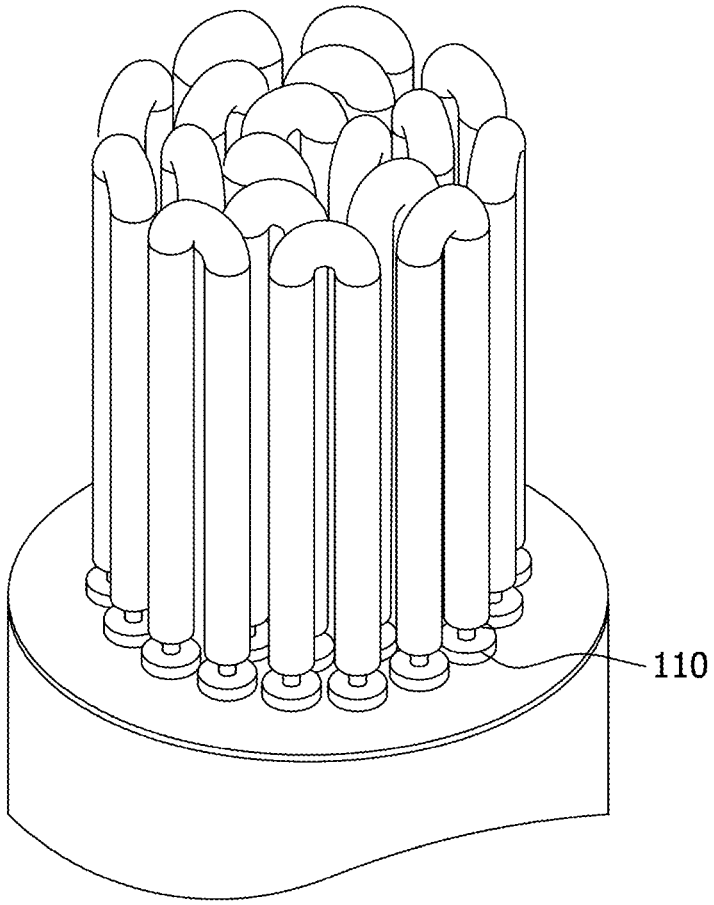
FIG. 1 is a perspective view of an exemplary CVD reactor with an outer cover of the reactor removed and showing silicon deposited on seed rods.

The embodiments described herein generally relate to systems and methods for machining silicon seed rods for use in a chemical vapor deposition (CVD) polysilicon reactor. These silicon seed rods are then used during production of polysilicon in the CVD reactor. While reference is made herein to machining silicon seed rods, these systems and methods described herein may also be used to machine other semiconductor and solar materials. An exemplary CVD reactor is shown in FIG. 1 and indicated generally at 10. This reactor 10 depicted in FIG. 1 is shown after completion of the chemical vapor deposition process, and thus the seed rods are not readily visible.

Figure 2:
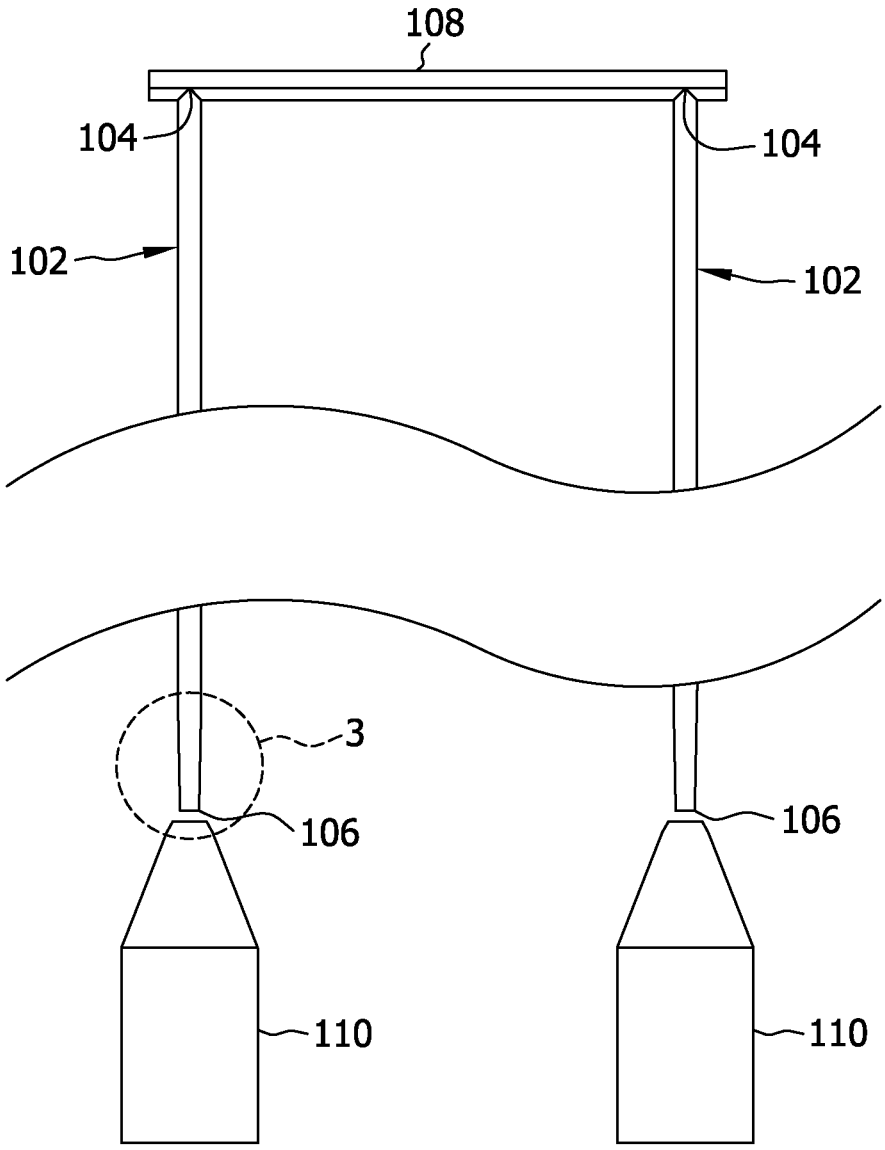
FIG. 2 is a partial schematic view of a pair of silicon seed rods and a chuck used in the reactor of FIG. 1.
Figure 3:
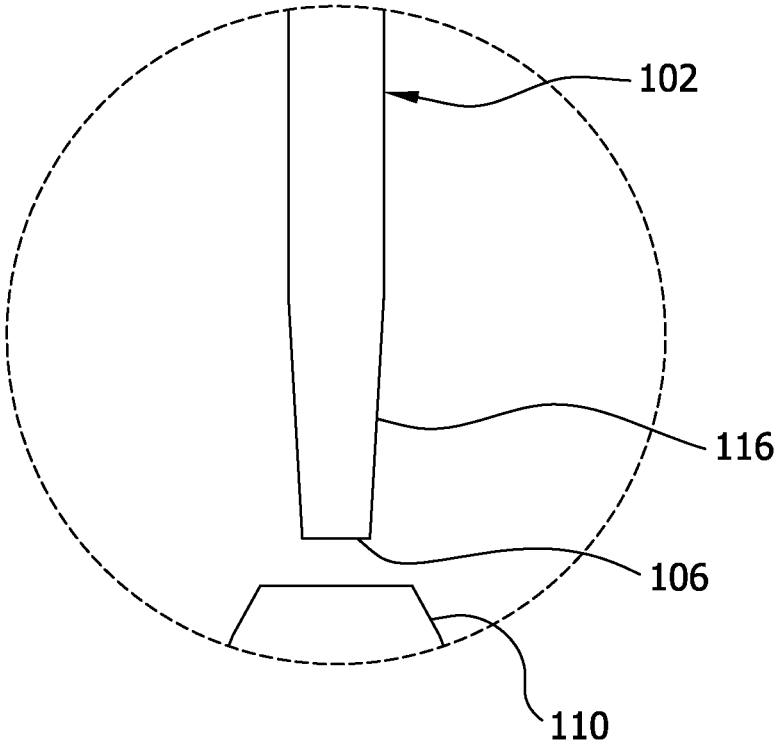
FIG. 3 is an enlarged view of a portion of FIG. 2.
Figure 4:
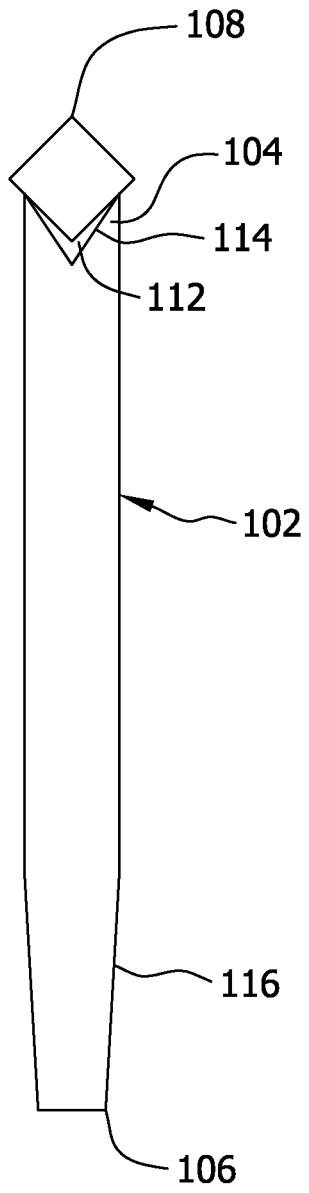
FIG. 4 is a side view of FIG. 2.

An exemplary system for machining the silicon seed rods 102 is indicated generally at 100 in FIGS. 5 through 8, while the seed rods are shown in greater detail in FIGS. 2-4. FIG. 2 depicts a partial schematic view of a pair of silicon seed rods and a chuck used to connect the rods to a reactor (such as the reactor 10). The silicon seed rods 102 (FIG. 2) may be cut from ingots formed according to any suitable process, such as the Czochralski process. In the example embodiment, the larger silicon ingots may have a length of up to about 3000 mm and a diameter of up to about 125 mm. The silicon ingots are cut by one or more saws to form the seed rods 102. The seed rods 102 typically have a length of about 2-3 m, or about 2500 mm, and a square cross-section of about 7 to about 11 mm, or about 9 mm by 9 mm.

Each of the seed rods 102 has a first end 104 and a second end 106. Pairs of silicon seed rods 102 are connected in the reactor at their respective first ends 104 by a silicon bridge rod 108. The opposing second ends 106 of the silicon seed rods 102 are connected to a graphite chuck 110 within the reactor.

As described in greater detail below, the first ends 104 of the seed rods 102 are machined such that they have a V-shaped or dovetail-like profile 114 (e.g., a dovetail joint). This profile 114 of the first ends 104 is shown in FIG. 4. The profile in the first end 104 forms a channel 112 in which the bridge rod 108 is received. As shown in FIG. 3, the second ends 106 of the rods 102 are machined to have a conical profile 116 to facilitate connecting the second ends to the graphite chuck 110. In the depiction of FIG. 3, second end 106 is shown spaced from the chuck 110 to better show the conical profile 116. This second end 106 is thereafter moved (downward in FIG. 3) so that at least a portion of the second end 106 is received within an opening in the chuck 110. The conical profile 116 of the second end 106 facilitates correct placement of the seed rod 102 within the opening in the chuck 110.

As shown in FIGS. 5-8, the system 100 has a frame 120 for holding the seed rods. A first grinding wheel 122 and a second grinding wheel 124 are positioned adjacent the frame 120. The grinding wheels 122, 124 are used to machine the profiles described above into the ends 104, 106 of each silicon seed rod 102. In the example embodiment, the grinding wheels 122, 124 are of the ordinary abrasive composite type which includes a material having a composition (e.g., diamond coated) operable to machine the desired profiles in the ends 104, 106 of each seed rod 102.

Each of the grinding wheels 122, 124 is connected to one of a respective first drive source 132 and second drive source 134, which are in turn connected either directly to the frame 120 or by additional structures. These additional structures can comprise actuators (e.g., linear, pneumatic, or hydraulic actuators) operable to move the grinding wheels 122, 124 with respect to the frame 120. Alternatively, or in addition to, other actuators may be connected to the frame 120 to move the silicon seed rods 102 with respect to the frame. In these embodiments, the grinding wheels 122, 124 may remain stationary with respect to the frame and the seed rods are movable. Alternatively, both the seed rods 102 and the grinding wheels 122, 124 may be movable.

In the example embodiment, the drive sources 132, 134 are electric motors while in other embodiments the drive sources may be any other mechanism capable of rotating the grinding wheels. Examples include hydraulic or pneumatic motors.

A suitable conveyance mechanism 160 is positioned adjacent the frame 120 for moving the silicon seed rods 102 with respect to the frame. The conveyance mechanism 160 may comprise one or more actuators, conveyors, loaders and other suitable mechanisms and associated control mechanisms.

Figure 5:
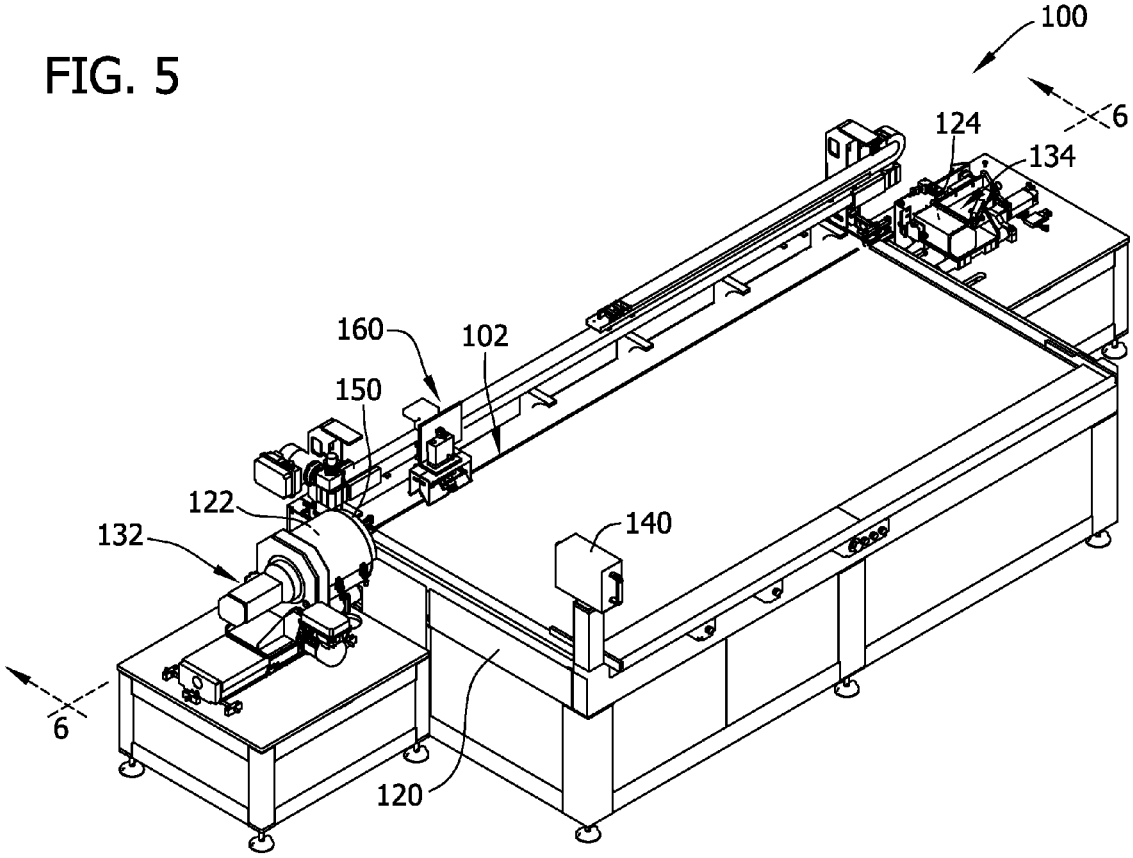
FIG. 5 is a perspective view of a system for machining silicon seed rods.
Figure 6:
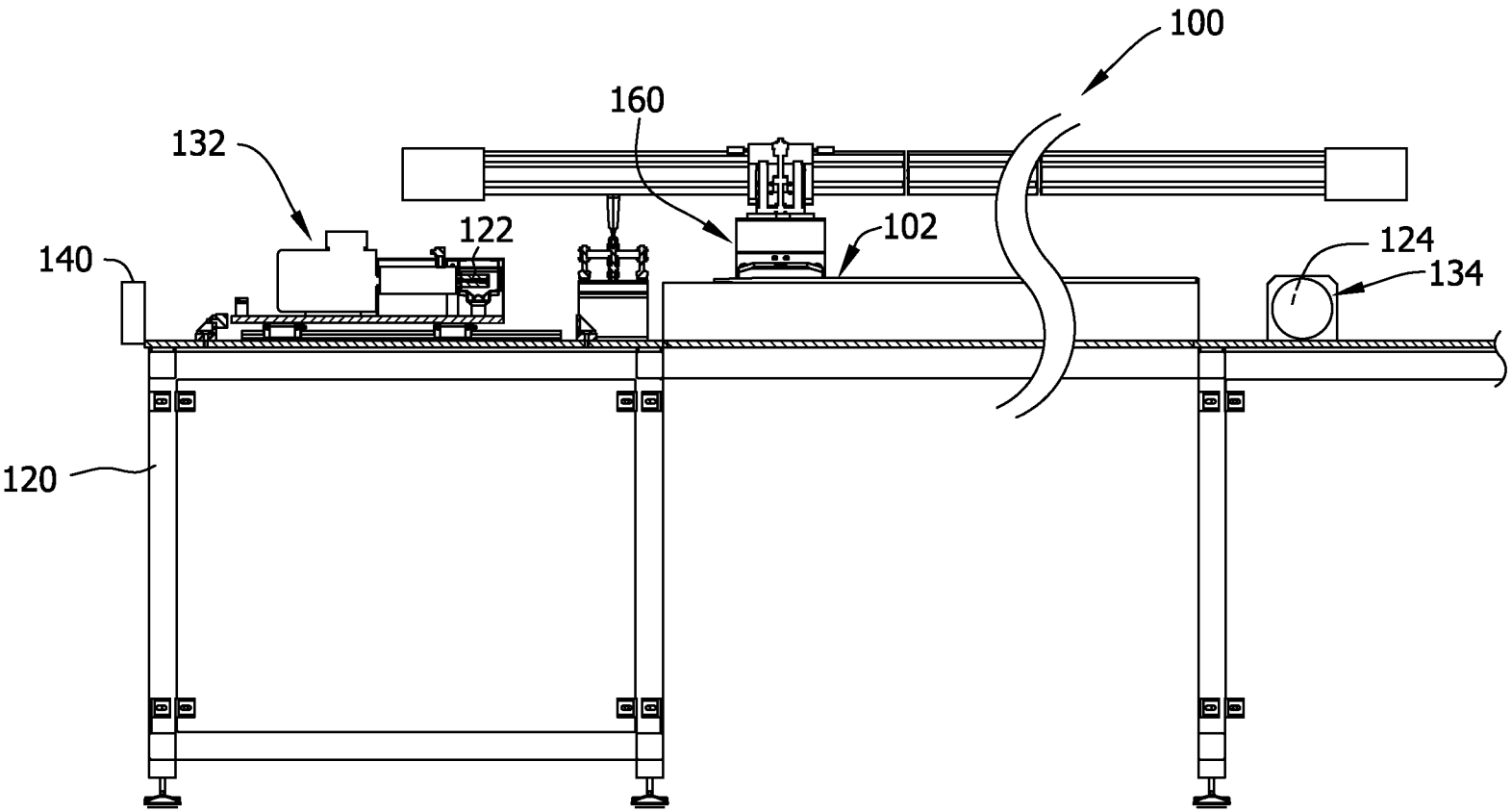
FIG. 6 is a front view of the system of FIG. 5.
Figure 7:
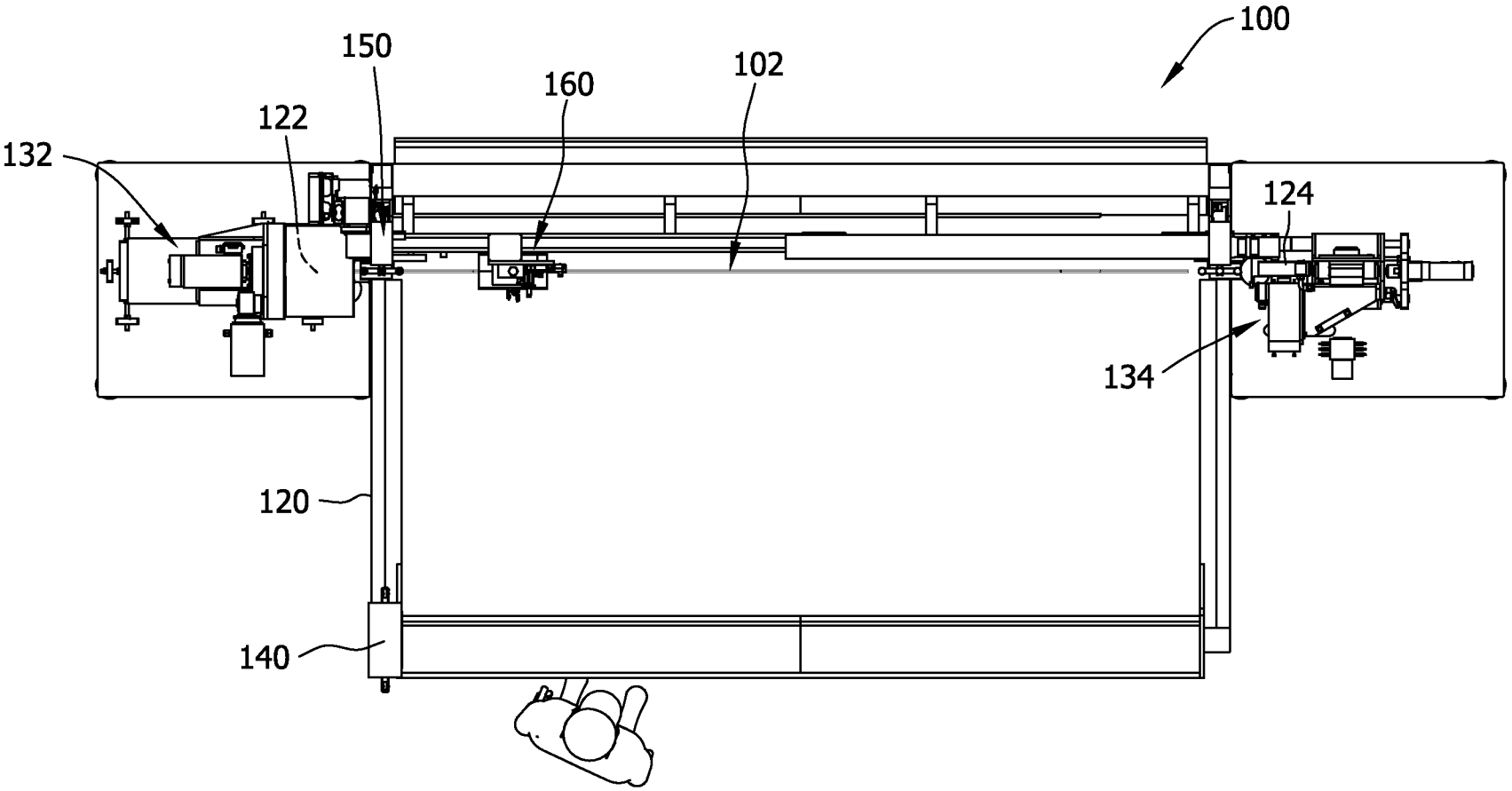
FIG. 7 is a top view of the system of FIG. 5.
Figure 8:
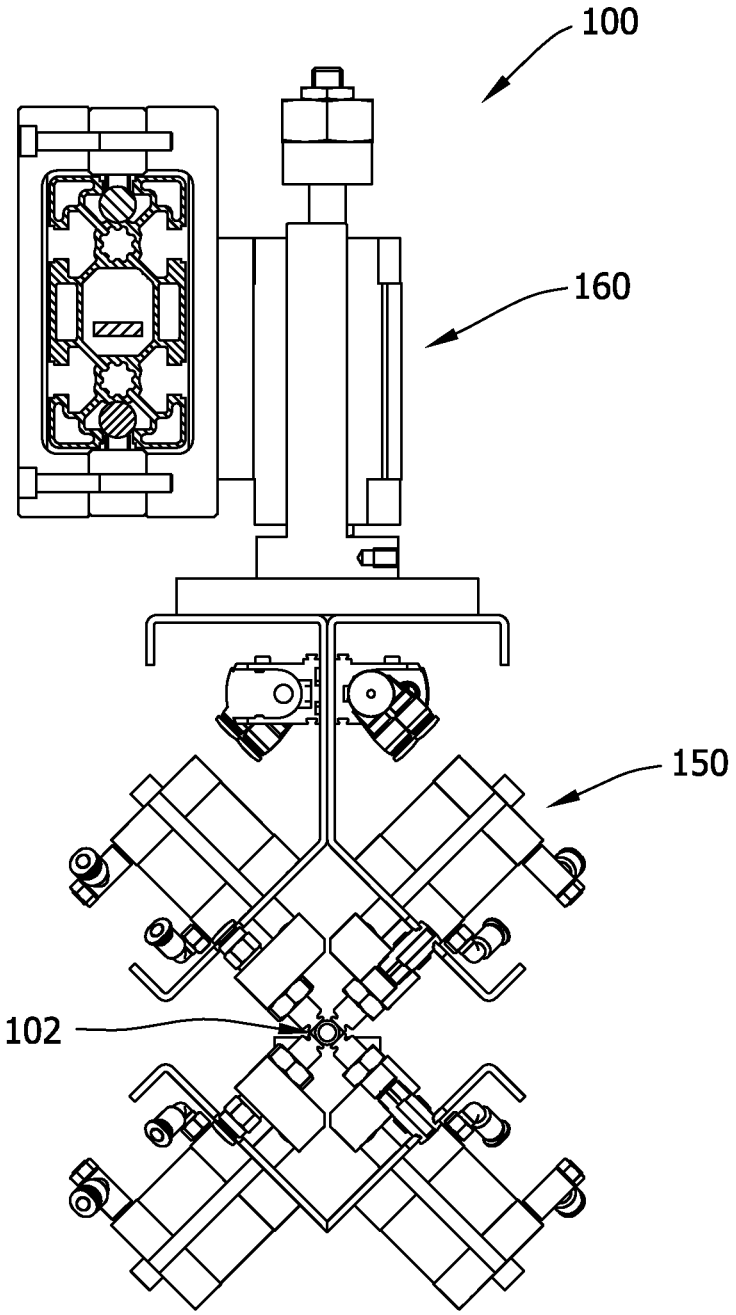
FIG. 8 is an end view of the system of FIG. 5 with a frame of the system omitted for clarity.

Operation of the drive sources 132, 134, and hence operation of the grinding wheels 122, 124, is controlled by a control system 140 (shown schematically in FIG. 5). The control system 140 can comprise, among other components, one or more processors, programmable logic controllers (PLCs), computer readable storage mediums, and input/output devices. The control system 140 controls operation of the grinding wheels 122, 124 by controlling the flow of electricity (power) to the respective drive sources 132, 134 connected to the grinding wheels. The control system 140 is communicatively coupled to the conveyance mechanism 160 to control its operation.

In the example embodiment, the control system 140 includes an optical measurement system 150. This optical measurement system 150 measures the second end 104 of the silicon seed rods 102. The optical measurement system 150 uses one or more lasers or other suitable optical devices to measure the shape (i.e., profiles 116) of the ends of the seed rods 102. In one embodiment, only the shape of the second end is measured. Four lasers are used to determine the shape of the cone or conical profile at four points. This measurement occurs after the ends 104, 106 are machined by the grinding wheels.

The optical measurement system 150 is connected or communicatively coupled to the control system 140 by any suitable wired or wireless communication system. The optical measurement system 150 is operable to send as an output the shape of the second end 106 of the seed rod 102 to the control system 140. Based on this received output, the control system 140 is operable to control operation of the drive sources 134 (and thus the grinding wheels). In this embodiment, if the four points of the cone are determined to be within tolerance, the grinding operation is complete. If they are not within tolerance, grinding may continue or the rod may be rejected (indicating the rod is defective). Note that if multiple rods are rejected, the control system may indicate to the operator that maintenance or repair of the grinding wheel is needed. Other methods may also be used by the control system 140 to control operation.

Control of the operation of the drive sources 132, 134 can include altering the rotational velocity of the drive sources and thus the rotational velocity of the grinding wheels 122, 124 attached thereto. Such control can also include the adjustment of the position of the seed rods 102 and/or the position of the grinding wheels 122, 124 with respect to the frame 120. Actuators or other suitable devices can be used to move or adjust the position of the seed rods 102 (e.g., the conveyance system 160) and/or grinding wheels 122, 124 (or the drive sources 132, 134). Such actuators can be connected to the control system 140 such that the control system can control their operation. Note that a control system of another embodiment may control the machining of the first end by the first grinding wheel based at least in part on the output of the optical measure system.

During use of the system 100, the seed rods 102 are first loaded on the frame 120. One of the rods 102 is then moved by the conveyance system 160 to a position such that the first end 104 of the rod is adjacent the first grinding wheel 122. The first grinding wheel 122 is then used to grind the v-shaped (i.e., dove tail) profile 114 into the first end 104 of the rod 102.

The seed rod 102 is then moved by the conveyance system 160 to a position such that the second end 106 of the rod is adjacent the second grinding wheel 124. Alternatively, the seed rod 102 may remain substantially stationary after being machined by the first grinding wheel 122.

The second grinding wheel 124 is then used to grind the conical profile 116 into the second end 106 of the seed rod 102. The control system 140 may control the machining of the second end 106 by the second grinding wheel 124 based at least in part on the output of the optical measurement system 150. The conveyance system 160 may then move the rod 102 to another position away from the grinding wheels 122, 124 and/or frame 120. The process is then repeated for each of the remaining seed rods 102. In other embodiments, the process may be reversed such that the second end 106 of the seed rod 102 is machined prior to or contemporaneously as the first end 104.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the invention, it is intended that all matter contained in the above description and shown in the accompanying drawing[s] shall be interpreted as illustrative and not in a limiting sense.

What is claimed is:

1. A method for machining a profile into a silicon seed rod using a machine, the silicon seed rod used in a chemical vapor deposition polysilicon reactor, the machine comprising a plurality of grinding wheels, the method comprising:

providing a silicon seed rod having a first end and an opposing second end;

grinding a v-shaped profile into an end face of the first end of the silicon seed rod with one of the plurality of grinding wheels; and grinding a conical profile in the second end of the silicon seed rod with another of the plurality of grinding wheels.

2. The method of claim 1 wherein a rate of the grinding of the conical profile in the second end is controlled based at least in part on an output of an optical measurement system.

3. The method of claim 2 wherein the optical measurement system measures an angle of the conical profile and outputs the measurement to the system.

4. The method of claim 1 wherein at least a portion of the second end is shaped to be received within a chuck of the reactor.

5. The method of claim 1 further comprising loading a seed rod into the machine.

6. The method of claim 5 wherein the seed rod is moved by a conveyance system so that the first end comes into contact with one of the plurality of grinding wheels.

7. The method of claim 6 wherein the seed rod is moved by the conveyance system so that the second end comes into contact with another of the plurality of grinding wheels.

8. The method of claim 1 wherein the silicon seed rod is one of a plurality of silicon seed rods, the method further comprising loading the plurality of seeds rods into the machine, and moving one of the plurality of seed rods using a conveyance system such that a first end of the silicon seed rod comes into contact with one of the plurality of grinding wheels.

9. The method of claim 1 further comprising measuring at least one of the v-shaped profile and the conical profile with an optical measurement system, and rejecting the silicon seed rod based at least in part on an output of the optical measurement system.

10. The method of claim 1 wherein the v-shaped profile forms a channel configured to receive a bridge rod.

11. The method of claim 1 wherein the silicon seed rod has a length of between about 2,000 millimeters (mm) and about 3,000 mm.

12. The method of claim 1 wherein the silicon seed rod has a cross-sectional area of between about 70 $mm^2$ and about 90 $mm^2$.

13. The method of claim 1 wherein the silicon seed rod has a square-shaped cross-section.

* * * * *